US011486064B2

(12) United States Patent
Keum et al.

(10) Patent No.: US 11,486,064 B2
(45) Date of Patent: Nov. 1, 2022

(54) WOVEN/KNIT FABRIC

(71) Applicant: Toray Industries, Inc., Tokyo (JP)

(72) Inventors: Aram Keum, Otsu (JP); Hiroshi Tsuchikura, Otsu (JP)

(73) Assignee: TORAY INDUSTRIES, INC., Tokyo (JP)

( * ) Notice: Subject to any disclaimer, the term of this patent is extended or adjusted under 35 U.S.C. 154(b) by 179 days.

(21) Appl. No.: 16/968,188

(22) PCT Filed: Jan. 9, 2019

(86) PCT No.: PCT/JP2019/000400
§ 371 (c)(1),
(2) Date: Aug. 7, 2020

(87) PCT Pub. No.: WO2019/159569
PCT Pub. Date: Aug. 22, 2019

(65) Prior Publication Data

US 2021/0372015 A1 Dec. 2, 2021

(30) Foreign Application Priority Data

Feb. 14, 2018 (JP) ..... JP2018-024424

(51) Int. Cl.
*D03D 15/56* (2021.01)
*D03D 15/47* (2021.01)
(Continued)

(52) U.S. Cl.
CPC ..... *D03D 15/56* (2021.01); *D03D 15/47* (2021.01); *D03D 15/587* (2021.01); *D04B 21/18* (2013.01); *D10B 2401/061* (2013.01)

(58) Field of Classification Search
CPC ..... D03D 15/56; D03D 15/47; D03D 15/587; D04B 21/18; D10B 2401/061
See application file for complete search history.

(56) References Cited

U.S. PATENT DOCUMENTS 8,247,490 B1 * 8/2012 Li ..... C08L 61/06 524/510
8,651,157 B2 * 2/2014 Michiels ..... B60C 1/00 152/565
(Continued)

FOREIGN PATENT DOCUMENTS

JP 531874 B2 1/1978
JP 5437903 Y2 11/1979
(Continued)

OTHER PUBLICATIONS

Extended European Search Report for European Application No. 19754740.9, dated Oct. 26, 2021, 9 pages.
(Continued)

*Primary Examiner* — Robert H Muromoto, Jr.
(74) *Attorney, Agent, or Firm* — RatnerPrestia

(57) ABSTRACT

A woven/knit fabric, comprising two or more types of yarn different in elongation rate, wherein the two or more types of yarn different in elongation rate are separately arranged as independent threads in the same direction in at least one of warp and weft; and wherein a stress-strain curve obtained by applying load in a direction parallel to the direction of the arrangement of the threads has an inflection point; and includes a point satisfying an equation:

$$2.5 \leq B/A$$

where, with a reference where the woven/knit fabric is subjected to load and has an elongation of P (%), A is an elastic modulus of the woven/knit fabric when the woven/knit fabric is subjected to load and has an elongation of (P×0.8) (%) and B is an elastic modulus of the woven/knit fabric when the woven/knit fabric is subjected to load and has an elongation of (P×1.2) (%).

6 Claims, 1 Drawing Sheet

(51) Int. Cl.

| | |
|---|---|
| ***D03D 15/587*** | (2021.01) |
| ***D04B 21/18*** | (2006.01) |
| *D03D 17/00* | (2006.01) |

(56) References Cited

U.S. PATENT DOCUMENTS

| | | | | |
|---|---|---|---|---|
| 9,987,186 | B1 * | 6/2018 | Lynch | A61F 5/058 |
| 10,405,594 | B2 * | 9/2019 | Underwood | A41D 27/02 |
| 10,448,683 | B2 * | 10/2019 | Hoverter | A41D 13/02 |
| 10,465,102 | B2 * | 11/2019 | Li | C08L 15/005 |
| 10,548,356 | B2 * | 2/2020 | Flockton | A41D 27/245 |
| 10,631,583 | B2 * | 4/2020 | Musciacchio | A41D 7/005 |
| D882,908 | S * | 5/2020 | Carn-Holmes | D2/731 |
| 10,813,390 | B2 * | 10/2020 | Joseph | A41D 7/005 |
| 10,897,936 | B2 * | 1/2021 | Berger | A41D 7/00 |
| 10,905,175 | B1 * | 2/2021 | DiLorenzo | A41D 27/02 |
| 2009/0099497 | A1 * | 4/2009 | Jung | D03D 15/56 602/76 |
| 2009/0294008 | A1 * | 12/2009 | Michiels | B60C 9/2009 152/527 |
| 2015/0201682 | A1 * | 7/2015 | Musciacchio | A41D 7/005 2/67 |
| 2016/0128484 | A1 * | 5/2016 | Gross | B32B 27/36 442/221 |

FOREIGN PATENT DOCUMENTS

| | | | |
|---|---|---|---|
| JP | 5517143 | B1 | 5/1980 |
| JP | 2000345446 | A | 12/2000 |
| JP | 2001106023 | A | 4/2001 |
| JP | 2003182512 | A | 7/2003 |
| JP | 2005256255 | A | 9/2005 |
| JP | 2009501033 | A | 1/2009 |
| JP | 2011521832 | A | 7/2011 |
| JP | 2012036541 | A | 2/2012 |
| JP | 2017190548 | A | 10/2017 |
| SU | 1384629 | A1 | 3/1988 |
| WO | 2007009625 | A1 | 1/2007 |
| WO | 2009144244 | A1 | 12/2009 |

OTHER PUBLICATIONS

International Search Report and Written Opinion for International Application No. PCT/JP2019/000400, dated Apr. 2, 2019, 9 pages.

International Preliminary Report on Patentability and Written Opinion for International Application No. PCT/JP2019/000400, dated Aug. 18, 2020, 13 pages.

* cited by examiner

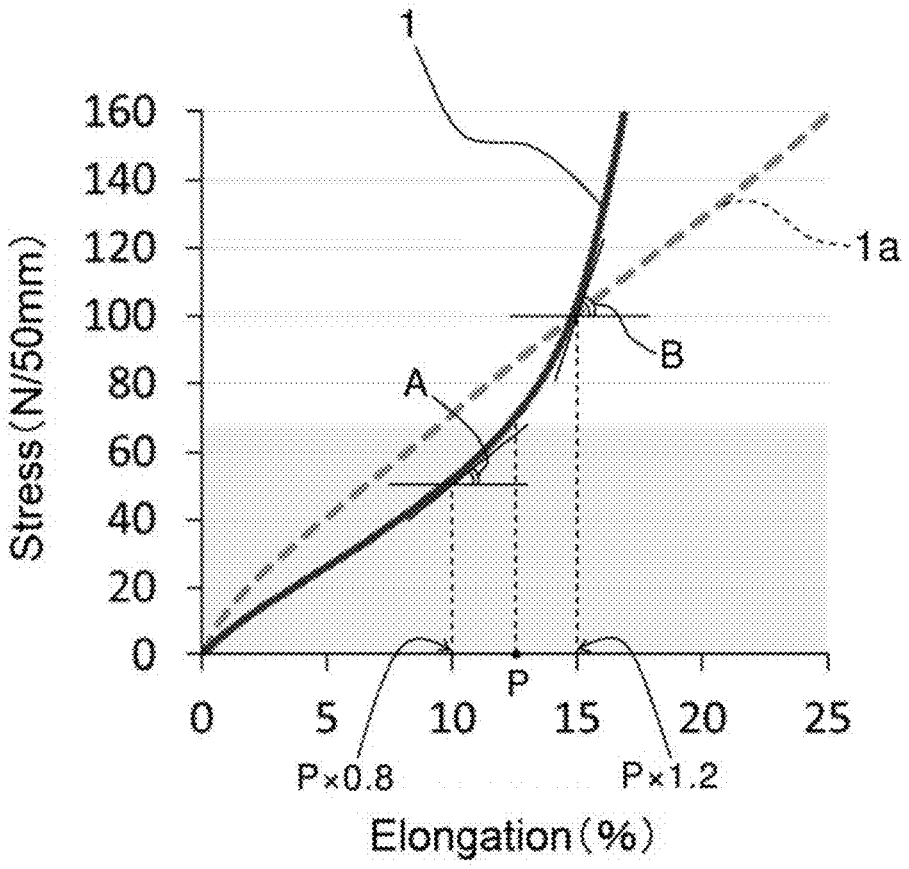
1
1a
A
B
160
140
120
100
80
60
40
20
0
Stress (N/50mm)
0
5
10
15
20
25
P
P×0.8
P×1.2
Elongation (%)

WOVEN/KNIT FABRIC

CROSS REFERENCE TO RELATED APPLICATIONS

This is the U.S. National Phase application of PCT/JP2019/000400, filed Jan. 9, 2019, which claims priority to Japanese Patent Application No. 2018-024424, filed Feb. 14, 2018, the disclosures of each of these applications being incorporated herein by reference in their entireties for all purposes.

FIELD OF THE INVENTION

The present invention is related to a woven/knit fabric. More specifically, the present invention is an elastic woven fabric varying its elastic modulus according to elongation regions, wherein the elastic woven fabric is moderately elastic in a low elongation region in ordinary use and significantly less elastic in a higher elongation region, and suitable for use in various clothing materials and industrial use, such as construction materials, safe materials, clothing materials, agricultural materials, materials for vehicle, and sports equipment, especially for use in sportwear and sports equipment requiring high-performing elastic characteristics.

BACKGROUND OF THE INVENTION

Conventionally, an elastic, stretch fabric has been widely used, mainly for clothing. Especially, for the usage where lightweight materials are required, stretch woven fabrics are more likely to be used than stretch knitted fabrics. Also, in recent years, especially in usage for sports, higher elastic characteristics has been demanded. Patent Document 1 discloses an elastic woven fabric being elastic in a high load region and having high recovery. Patent Document 2 discloses an elastic woven fabric in which non-elastic yarn and elastic yarn are arranged in the same direction.

PATENT DOCUMENT

Patent Document 1: JP 2012-36541 A
Patent Document 2: JP 2005-256255 A

SUMMARY OF THE INVENTION

For elastic fabric, optimization of elongation and elastic stress in ordinary use regions is important. However, the problem is that when stress larger than the stress applied in an ordinary use region is applied to an elastic fabric, its elastic yarn which allows for the elasticity of the fabric is forced to be elongated to its plastic deformation region, and the recovery rate is significantly reduced. Especially, for use in sports, elasticity that is suitable for ordinary exercise is required. However, for use in sports, it is also important for an elastic fabric that, in terms of safety, when a non-stationary accident such as falling down is occurred, the elastic modulus of the elastic fabric is increased to restrain the elasticity so that excessive deformation of the body can be prevented. However, from this point of view, an elastic woven fabric that varies its elastic modulus according to elongation regions has not conventionally existed. The woven fabric disclosed in Patent Document 1 does not meet such requirements.

Also, the elastic woven fabric disclosed in Patent Document 2 varies its elastic modulus according to elongation regions. However, this variation of elastic modulus thereof just aims for the effect of surface roughness, and the fabric is not expected to be used in a high elongation region where the elastic modulus varies. Therefore, the problem is that the elastic woven fabric disclosed in Patent Document 2 does not have enough variation width of its elastic modulus.

This invention is made in consideration of this conventional problem and aims to provide a woven/knit fabric which is moderately elastic in a low elongation region in ordinary usage and, in a high elongation region in irregular usage, has a significantly increased elastic modulus to be less stretchable, thereby providing its end product with an excellent functionality.

A woven/knit fabric of one embodiment of the invention solving the above problem comprises two or more types of yarn different in elongation rate, wherein the two or more types of yarn different in elongation rate are separately arranged as independent threads in the same direction in at least one of warp and weft; and wherein a stress-strain curve obtained by applying load in a direction parallel to the direction of the arrangement of the threads has an inflection point; and includes a point satisfying an equation:

$$2.5 \leq B/A$$

where, with a reference where the woven/knit fabric is subjected to load and has an elongation of P (%), A is an elastic modulus of the woven/knit fabric when the woven/knit fabric is subjected to load and has an elongation of (P×0.8) (%) and B is an elastic modulus of the woven/knit fabric when the woven/knit fabric is subjected to load and has an elongation of (P×1.2) (%).

BRIEF DESCRIPTION OF THE DRAWINGS

The FIGURE is a graph showing stress-strain curves of a woven/knit fabric of one embodiment of the invention and an ordinary elastic woven fabric.

DETAILED DESCRIPTION OF EMBODIMENTS OF THE INVENTION

<Woven/Knit Fabric>

A woven/knit fabric of one embodiment of the invention comprises two or more types of yarn different in elongation rate. In the woven/knit fabric, the two or more types of yarn different in elongation rate are separately arranged as independent threads in the same direction in at least one of warp and weft. Also, in the woven/knit fabric, a stress-strain curve obtained by applying load in a direction parallel to the direction of the arrangement of the threads has an inflection point. Also, this stress-strain curve includes a point satisfying an equation:

$$2.5 \leq B/A$$

where, with a reference where the woven/knit fabric is subjected to load and has an elongation of P (%), A is an elastic modulus of the woven/knit fabric when the woven/knit fabric is subjected to load and has an elongation of (P×0.8) (%) and B is an elastic modulus of the woven/knit fabric when the woven/knit fabric is subjected to load and has an elongation of (P×1.2) (%). Explanations are followed.

It should be noted that, in this embodiment, elongation rate is a value obtained from (L2−L1)/L1, where L1 is the length of the thread subjected to a load of 0.1 cN/dtex, and L2 is the length of the thread subjected to a load of 0.4 cN/dtex.

The difference between elongation rates is not specifically limited. For example, regarding the difference of elongation rates among the yarns in a thread, the elongation rate of the yarn having the highest elongation rate is preferably not less than 1.2 times greater, more preferably not less than 1.5 times greater than the elongation rate of the yarn having the lowest elongation rate. Also, the elongation rate of the yarn having the highest elongation rate is preferably not more than 20 times greater, more preferably not more than 15 times greater than the elongation rate of the yarn having the lowest elongation rate.

The woven fabric of this embodiment comprises the two or more types of yarn different in elongation rate as described above, and the two or more types of yarn different in elongation rate are separately arranged as independent threads in the same direction in at least one of warp and weft. From this, for example, when the woven fabric is stretched to a high elongation region, the yarn having low elongation rate stop stretching and the yarn having a high elongation rate may be prevented from stretching before reaching a plastic deformation region. Consequently, the woven fabric may be prevented from stretching more than required as a woven fabric and obtain excellent elongation recovery rate.

Yarns used for a woven/knit fabric of this embodiment are not specifically limited. The yarns are only required to have the above-described relationship between elongation rate, and natural fibers or synthetic fibers may be used High Elongation Rate Yarn The type of a high elongation rate yarn is not specifically limited. A high elongation rate yarn can be suitably selected in accordance with the elongation rate of a low elongation rate yarn to be used in combination. Therefore, when the low elongation rate yarn to be used in combination is a yarn having an extremely low elongation rate, such as rayon, the high elongation rate yarn may be, for example, a polyester false twist yarn, or the like. Similarly, when the low elongation rate yarn to be used in combination is a yarn having a relatively high elongation rate, such as bimetal crimped yarn, a yarn with even higher elongation rate such as urethane elastomer is preferably employed as the high elongation rate yarn. It should be noted that the high elongation rate yarn is preferably a yarn with high elongation rate and recovery, such as elastomeric yarns, more preferably a yarn comprising polyether-based elastomer, polysulfide-based elastomer, polyurethane-based elastomer and the like. With these yarns selected, the above-described difference in elongation rates in the relationship with the low elongation rate yarn is easier to be achieved.

It should be noted that, in this embodiment, the yarn with high elongation rate preferably comprises fused yarn with which yarns are fused. In the woven fabric of this embodiment, the yarn with high elongation rate and the yarn with low elongation rate are fused and fused points are formed at intersection points of the knit/woven structure so that the restriction force can be improved. As a result, the woven fabric to be obtained experiences little change in the knit/woven structure after repeated deformation of the woven/knit fabric and is improved in long term durability.

Also, the yarn is a multifilament or monofilament. The yarn is preferably a monofilament because its texture is hardly degraded when the surface layer is fused. The monofilament may be a conjugated yarn such as core-sheath conjugated yarn or a nonconjugated yarn, which is made of a single material. The monofilament is preferably a core-sheath conjugated yarn. When the monofilament, a core-sheath conjugated yarn, is used, the melting point of the material forming the sheath component of the monofilament is preferably lower by 10° C. than the melting point of the material forming the core component of the monofilament. The entire sheath part of the monofilament is preferably fused to another yarn. If the melting point of the sheath component of the monofilament is lower than the melting point of the core component of the monofilament +10° C., when the heat setting temperature is above the melting point of the core component, the core component tends to melt during heat setting, and the strength at fused parts may decline. It should be noted that the monofilament which is either the above-mentioned core-sheath conjugated yarn or nonconjugated yarn may be used without fusing.

When the monofilament is a core-sheath conjugated yarn, regarding the type of the material thereof, the core component and the sheath component may consist of the same component or may not. However, from the viewpoint of increasing the adhesive property between the core component and the sheath component, the core component and the sheath component preferably comprise the same component, and more preferably consist of the same component. Particularly, the monofilament is preferably a copolymer comprising a plurality of components comprising components, each of which has a common core component and sheath component, and more preferably is adjusted by changing the composition ratio of those plurality of components so that the core component and the sheath component have different melting points. Especially, from the viewpoint of adhesive property and yarn strength during heat setting, the monofilament is preferably a core-sheath conjugate yarn having a core component comprising polyester elastomer with a melting point of 190 to 250° C. and a sheath component comprising polyester elastomer with a melting point of 140 to 190° C.

The high elongation rate yarn is preferably a monofilament. Generally, among filaments made of the same polymer, filaments with higher fineness have higher flexural rigidity, and, if a monofilament and a multifilament are equal in total fineness, the monofilament tends to have higher flexural rigidity than the multifilament Therefore, if the high elongation rate yarn is a monofilament, elongation deformation and plastic deformation occurring when instantaneous, high load is applied thereto is likely to be restrained, and the yarn is likely to exhibit excellent elasticity. Consequently, the woven/knit fabric can have little structural change in stretching behavior, reducing hysteresis loss, and is excellent in recovery.

The content of the high elongation rate yarn is not specifically limited. For example, the content of high elongation rate yarn in the all yarns of the woven/knit fabric is preferably not less than 10 mass %, more preferably not less than 20 mass %. Also, the content of high elongation rate yarn in the all yarns of the woven/knit fabric is preferably not more than 90 mass %, more preferably 70 mass %. When the content of the high elongation rate yarn is within the above-mentioned range, the woven fabric to be obtained is likely to exhibit excellent stretching performance for smoothly stretching in accordance with the movement of the body with low elastic modulus in a low elongation region, which is considered to be in ordinary usage. Also, in a high elongation region in non-steady state, where high load is applied to the woven fabric, the elastic modulus is increased, and unnecessary deformation is likely to be restrained.

Low Elongation Rate Yarn

The type of the low elongation rate yarn is not specifically limited. The low elongation rate yarn is suitably selected in accordance with the elongation rate of the high elongation rate yarn that is used together. Examples of the low elongation rate yarn include yarns comprising polyethylene terephthalate, polybutylene terephthalate, polypropylene terephthalate, or copolymers or polyamides thereof and metallic fiber. Among those, the low elongation rate yarn is preferably a yarn having heat setting property.

The low elongation rate yarn is preferably a multifilament. Generally, among filaments made of the same polymer, if a multifilament and a monofilament are equal in total fineness, the multifilament has a smaller single fiber diameter and tends to be deformed when it comes to contact with skin. Therefore, soft feel is easy to be obtained with a multifilament.

It should be noted that when the woven/knit fabric is elongated to the high elongation region and then the load is released, the yarn with low elongation rate is easy to loosen, and plucking and fluffing tends to occur. Therefore, in order to store such loosening, the low elongation rate yarn is preferably a yarn, a single fiber of which is crimped, more preferably a false twist crimped yarn or a bimetal crimped yarn.

Also, the strength of the low elongation rate yarn is not specifically limited. For example, the strength of the low elongation rate yarn is preferably not less than 3.0 cN/dtex, more preferably not less than 5.0 cN/dtex. When the strength is within this range, the strength of the woven/knit fabric to be obtained is excellent in strength. It should be noted that the upper limit of the strength is not specifically limited. Practically, the upper limit of the strength may be not more than 15.0 cN/dtex. It should be noted that the tensile strength of yarn can be calculated by the measurement under constant rate of elongation conditions specified in JIS L 10138.5.1 standard time test.

Now, back to description of the yarn itself, the total fineness of the yarn is not specifically limited. The total fineness of the yarn is preferably not less than 30 dtex, more preferably not less than 50 dtex. Also, the total fineness of the yarn is preferably not more than 3000 dtex, more preferably not more than 2000 dtex. When the total fineness of the yarn forming the woven/knit fabric is within the above-described range, the woven fabric to be obtained tends to achieve strength and lightweight property compatibly. It should be noted that, in this embodiment, the total fineness of yarn can be calculated in accordance with, for example, JIS L 1013 (1999) 8.3.1 fineness based on corrected weight b) B method. Specifically, it can be calculated as a value obtained by measuring the weight of a test piece sampled by multiplying an initial load of 0.882 mN/dtex and put in an absolute dry condition, and multiplying it by the standard moisture regain specified in JIS L 01053.1 (where the standard moisture regains of polyamide and polypropylene are 4.5% and 0%, respectively).

The single fiber fineness is preferably not less than 1 dtex, more preferably not less than 2 dtex. Also, the single fiber fineness is preferably not more than 10 dtex, more preferably not more than 6 dtex. When the single fiber fineness is within the above-described range, the hardness (feeling) of the woven/knit fabric to be obtained is suitable for sportswear and preferable. It should be noted that the single fiber fineness can be calculated by dividing the total fineness by the filament number. A filament number can be calculated based on the method of JIS L 1013(1999) 8.4.

The sectional shape of a fiber forming the yarn is not specifically limited. For example, the sectional shape of a single fiber may be a circular cross section, various modified cross sections, or a hollow fiber. Examples of the various modified cross sections include flat, triangular, C-shaped, T-shaped, Y-shaped, ball-shaped, hollow-shaped cross sections, and others.

The cover factor of the woven/knit fabric of this embodiment is preferably not less than 1200, more preferably not less than 1400. Also, the cover factor is preferably not more than 2400, more preferably not more than 2000. When the cover factor is within the above-described range, the woven/knit fabric to be obtained tends to achieve excellent air permeability and strength compatibly. It should be noted that, in this embodiment, a cover factor (CF) is defined as:

$$CF=(DW)^{1/2}\times MW+(DF)^{1/2}\times MF$$

where DW is a total fineness of warp (dtex), MW is a weaving density of warp (the number of yarns/inch), DF is a total fineness of weft (dtex), and MF is a weaving density of weft (the number of yarns/inch).

In this manner, the woven/knit fabric of this embodiment comprises at least two or more types of yarn including the above-described high elongation rate yarn and low elongation rate yarn, wherein these two or more types of yarn different in elongation rate are separately arranged as independent threads in the same direction in at least one of warp and weft. Here, if the yarns different in elongation rate are not arranged as independent threads in a woven/knit fabric, but arranged in the same yarn by twisting or air blending, fine woven fabric design tends to be interfered as other factors affecting stretching performance, such as friction between fibers and generation of torque, is likely to be generated. In the woven/knit fabric of this embodiment, these factors are less likely to be generated and fine woven fabric design is possible because yarns different in elongation rate are arranged in the same direction as independent threads. It should be noted that, in this embodiment, the expression "arranged in the same direction" means that two or more types of yarn are arranged alternatively in the weave structure direction or the direction perpendicular thereto.

Next, characteristics of the woven/knit fabric of this embodiment will be explained with reference to stress-strain curves (stress-elongation curve). The FIGURE is a graph showing stress-strain curves for the woven/knit fabric of this embodiment and a conventional elastic woven fabric (for example, a woven/knit fabric comprising one type of yarn). It should be noted that the stress-strain curves show elongation (%) when load (N/50 mm) is applied in a direction parallel to the direction in which the threads comprising yarns different in elongation rate are arranged. This stress-strain curve can be measured with, for example, a constant-rate-of-elongation testing machine.

As shown in the FIGURE, the elongation of the conventional elastic woven fabric, in the measuring range, becomes higher in proportion to the applied load. That is, such conventional elastic woven fabric shows excellent elongation in a high elongation region as well as a low elongation region, and, therefore, cannot prevent itself from deforming excessively in the case, in non-steady state, the fabric is stretched as much as it reaches a high elongation region.

On the other hand, the woven/knit fabric of this embodiment has inflection points, as shown in the FIGURE. The positions and number of the inflection points are not specifically limited. The number of inflection points can be suitably adjusted in accordance with the number of types of yarns different in elongation rate used for the woven fabric. When the woven/knit fabric comprises two types of a high elongation rate yarn and a low elongation rate yarn, the woven/knit fabric usually shows a stress-strain curve having one inflection point. On the other hand, when the woven/knit fabric comprises three or more types of yarn different in elongation rate, the woven/knit fabric can have two or more inflection points. Also, positions of inflection points can be adjusted by adjusting the elongation rate in the low elongation rate yarn. Accordingly, the inflection point can be suitably adjusted for the purpose of use of the woven/knit fabric by suitably selecting materials of the low elongation rate yarn according to the purpose of use.

Also, the woven/knit fabric includes a point satisfying an equation:

$$2.5 \leq B/A$$

where, with a reference where the woven/knit fabric is subjected to load and has an elongation of P (%), A is an elastic modulus of the woven/knit fabric when the woven/knit fabric is subjected to load and has an elongation of (P×0.8) (%) and B is an elastic modulus of the woven/knit fabric when the woven/knit fabric is subjected to load and has an elongation of (P×1.2) (%). It should be noted that in either case the elastic modulus is indicated by an inclination in the stress-strain curve. That is, for clarity of explanation, the FIGURE illustrates a graph when the elongation P (%) is 12.5%. Here, P×0.8(%) is 10.0%, and P×1.2(%) is 15.0%. The elastic modulus B (the inclination of the stress-strain curve when the elongation is 15.0%) is greater than the elastic modulus A (the inclination of the stress-strain curve when the elongation rate is 10.0%), and B/A is not less than 2.5.

The value of B/A is required to be not less than 2.5, preferably not less than 4.0, more preferably not less than 5.0. Also, the value of B/A is not specifically limited. For example, the value of B/A is, preferably not more than 12, more preferably not more than 10 to prevent the elastic modulus from changing so much that it causes impact. When the value of B/A is less than 2.5, the woven/knit fabric to be obtained elongates too much not only in a low elongation region, which is considered to be in ordinary usage, but also in a high elongation region in an irregular region in which the applied load is higher, and tends to be deformed unnecessarily.

Elongation recovery rate of the woven/knit fabric after the load is released from the situation in which the woven/knit fabric is subjected to load and has an elongation of (P×1.2) (%) is preferably not less than 90%, more preferably not less than 95%. That is, even when a large load is momentarily applied and the woven/knit fabric is elongated to a high elongation region, which is in an irregular region, it is preferable that the woven/knit fabric recovers its original shape when the load is released. From this, for example, clothes made of the woven/knit fabric can be continuously used unless it is damaged by load. When the elongation recovery rate is within the above-described range, the woven/knit fabric shows excellent elongation recovery rate and can realize high performance elastic characteristics that is required especially for sports equipment and others. It should be noted that, in this embodiment, the elongation recovery rate can be calculated as:

$$\{1-(Lb-La)La\}\times 100(\%)$$

where La is the length of the woven/knit fabric before elongation, and Lb is the length of the woven/knit fabric after the process in which the woven/knit fabric is subjected to load so that the elongation is P×1.2(%) and the load is released, and subsequently the woven/knit fabric is left standing for 24 hours under the standard state of a temperature of 20±2° C. and a relative humidity of 65±4%.

A manufacturing method of the woven/knit fabric of this embodiment is not specifically limited. The woven/knit fabric can be manufactured by a known conventional method. For the woven fabric, a plain weave, twill weave, satin weave, or a double weave or derivative weave of those weaves can be suitably selected in accordance with use. Also, the knitted fabric can be, for example, either a weft knit or a warp knit. Among those, generally, the woven fabric is preferably a plain weave texture for its simplicity. On the other hand, a low elongation yarn is more likely to loosen than a high elongation yarn. Therefore, it is preferably that a low elongation yarn has more weave constraint points and a high elongation yarn has less weave constraint points. Accordingly, a complex weaving design which is easy to express stretching behavior is preferably adopted for the woven fabric.

As above, one embodiment of the invention is described. The invention is not particularly limited to the above-described embodiment. It should be noted that the above-described embodiment is for mainly explaining an invention having the following configuration.

(1) A woven/knit fabric, comprising two or more types of yarn different in elongation rate, wherein the two or more types of yarn different in elongation rate are separately arranged as independent threads in the same direction in at least one of warp and weft; and wherein a stress-strain curve obtained by applying load in a direction parallel to the direction of the arrangement of the threads has an inflection point; and includes a point satisfying an equation:

$$2.5 \leq B/A$$

where, with a reference where the woven/knit fabric is subjected to load and has an elongation of P (%), A is an elastic modulus of the woven/knit fabric when the woven/knit fabric is subjected to load and has an elongation of (P×0.8) (%) and B is an elastic modulus of the woven/knit fabric when the woven/knit fabric is subjected to load and has an elongation of (P×1.2) (%).

According to this configuration, in the woven/knit fabric according to an embodiment of the invention, two or more types of yarn different in elongation rate are separately arranged as independent threads in the same direction. Also, in the woven/knit fabric, a stress-strain curve obtained by applying load in a direction parallel to the direction of the arrangement of the threads has an inflection point and includes, in terms of the elongation P (%), a point before and after which the elastic modulus is changed by a certain amount. Specifically, the woven/knit fabric is moderately elastic in a low elongation region in ordinary use and, in a high elongation region in irregular usage, becomes less elastic as the elastic modulus is significantly increased. Consequently, the woven/knit fabric can provide an end product requiring high-performing elastic characteristics with excellent functions.

(2) The woven/knit fabric of (1), wherein elongation recovery rate of the woven/knit fabric after the load is released from the situation in which the woven/knit fabric is subjected to load and has an elongation of (P×1.2) (%) is not less than 90%.

According to this configuration, the woven/knit fabric can exhibit excellent stretch recovery and realize high-performing elastic characteristics required for, especially, sports equipment and others.

(3) The woven/knit fabric of (1) or (2), wherein the content of a yarn having the highest elongation rate among the two or more types of yarn different in elongation rate in the entire yarn is 10 to 90 mass %.

According to this configuration, in the low elongation region in ordinary usage, where the elastic modulus is low, the woven/knit fabric can provide stretching performance for smoothly stretching in accordance with the movement of the body. In addition, in the high elongation region in irregular usage, where the elastic modulus is increased, the woven/knit fabric can restrain unnecessary deformation.

(4) The woven/knit fabric of any one of (1) to (3), wherein a yarn having the highest elongation rate among the two or more types of yarn different in elongation rate comprises fused yarn, in which yarns are fused each other.

According to this configuration, the woven fabric to be obtained experiences little change in the knit/woven structure after repeated deformation of the woven/knit fabric and is improved in long term durability.

(5) The woven/knit fabric of any one of (1) to (4), wherein a yarn having the highest elongation rate among the two or more types of yarn different in elongation rate is a monofilament.

According to this configuration, elongation deformation and plastic deformation occurring when instantaneous, high load is applied thereto is likely to be restrained, and the woven/knit fabric is likely to exhibit excellent elasticity.

(6) The woven/knit fabric of any one of (1) to (5), wherein a yarn having the lowest elongation rate among the two or more types of yarn different in elongation rate is a multifilament.

EXAMPLE

The invention is explained more specifically in the following examples. In the following, the invention is specifically explained with reference to examples. The invention is in no way limited to these examples. It should be noted that, in the following examples, characteristic values are calculated by the following methods. Also, measurement was carried out once unless otherwise stated.

<1. Weight Proportion>

A test piece of about 100 mm×100 mm is prepared, several yarns are loosened and collected (referred to as yarn A, yarn B, yarn C . . . , respectively) out of the test pieces; the weights of yarns (yarn A, yarn B, yarn C . . . ) which are arranged in one direction are measured; and the weight proportion of yarns are obtained from the following equations:

the weight proportion of yarn $A(W)=\{a/(a+b+c+\ldots)\}\times 100(\%)$;

the weight proportion of yarn $B(W)=\{b/(a+b+c+\ldots)\}\times 100(\%)$; and the weight proportion of yarn $C(W)=\{c/(a+b+c+\ldots)\}\times 100(\%)$, where a is the weight of yarn A (g); b is the weight of yarn B (g); and c is the weight of yarn C (g). The same applies, when 4 or more yarns are collected.

<2. Elongation Rate>

In a tensile load-deformation result curve measured with a tensile testing machine under the conditions of 250 mm of length between grips and a tensile rate of 200 mm/min in accordance with JIS L 1013:2010, a elongation rate is obtained from (L2−L1)/L1, where L1 is the length of the thread with a load of 0.1 cN/dtex applied thereto, and L2 is the length of the thread with a load of 0.4 cN/dtex applied thereto.

<3. Elongation Recovery Rate>

Elongation recovery rate is calculated as:

$$\{1-(Lb-La)/La\}\times 100(\%),$$

where La is a length of the woven/knit fabric before elongation, and Lb is a length of the woven/knit fabric after the process in which load is applied to the woven/knit fabric so that the elongation is P×1.2(%), the load is subsequently released, and then the woven/knit fabric is left standing for 24 hours in a standard state where the temperature is 20±2° C. and the relative humidity is 65±4%.

<4. Elastic Modulus of Woven Fabric>

A test piece of width 50 mm×length 300 mm is collected, and a stress-elongation curve is obtained by conducting a test with a constant-rate-of-elongation testing machine under the conditions of a length of 200 mm between grips and a tensile rate of 200 mm/min in accordance with JIS L 1096:20108.15 method (elongation elastic modulus at constant rate of elongation). In all elongation regions, from the following equation, an inclination of a tangent line of a graph is derived and an elastic modulus is obtained an elastic modulus at a % elongation=(Sa−Sb)/(a−b), stress at a % elongation [N/50 mm]: Sa, a—stress at 0.04% elongation [N/50 mm]: Sb, and a—elongation rate at 0.04% elongation: b For any elongation a %, inclinations of tangent lines of the graph at (a×0.8)% and (a×1.2)% elongations are calculated and an elastic modulus ratio(B/A) of two points is obtained from the following equations, and let P be an elongation rate a showing the largest elastic modulus ratio:

an elastic modulus at (a×0.8) % elongation: A an elastic modulus at (a×1.2) % elongation: B.

Example 1

Five 167 dtex-72 filaments yarns (WFOL manufactured by Toray Industries, INC.), which was a bright cation processed yarn, were doubled to make 835 dtex (total fineness)−480 filaments yarns, and yarns produced by twisting the above yarns with a warp twist coefficient 100S were used as parts of warp and weft. Also, for a part of the weft, a thermoplastic polyester elastomer, with "Hytrel (registered trademark)" 6347 manufactured by DU PONT-TORAY CO., LTD. having a melting point of 215° C. as a core component and "Hytrel (registered trademark)" 4056 having a melting point of 153° C. as a sheath component, was prepared, and after each pellet is dried, they are melted by different extruders, each of them is measured with a gear pump and allowed to flow into a composite pack, and supplied to an extruding machine, thereby obtaining a 700 dtex monofilament elastic yarn with a core to sheath weight proportion being 70:30. This elastic yarn was used as a part of the weft. Weaving conditions such as warp tension were adjusted to produce a woven fabric having a structure shown in Table 1, and the obtained woven fabric is subjected to heat treatment for two minutes at a temperature of 180° C., with a pin tenter, with the same width at entry and exit, at an overfeed ratio of 0% in the warp direction. Subsequently, dyeing process is carried out in accordance with an ordinary method for cationic dye dyeing process. In any of the finished woven fabrics, polyester elastomer of the sheath component is adhered and solidified at intersections of the warp and weft of the woven fabric. Also, the weaving density of the obtained woven fabric is as shown in Table 1.

TABLE 1

| | Examples | | | | | Comparative Examples | | | |
|---|---|---|---|---|---|---|---|---|---|
| | 1 | 2 | 3 | 4 | 5 | 1 | 2 | 3 | 4 |
| | Yarn properties Total fineness (dtex (number of yarns)) | | | | | | | | |
| Warp 1 | 835(480) | 835(480) | 835(480) | 835(480) | 835(480) | 835(480) | 835(480) | 835(480) | 835(240) |
| Weft 1 | 700(1) | 400(1) | 400(1) | 400(1) | 400(1) | 400(1) | 700(1) | 700(1) | 400(1) |
| Weft 2 | 835(480) | 835(480) | 835(480) | 835(480) | 835(480) | — | — | — | — |
| | Ratio (mass %) | | | | | | | | |
| Warp 1 | 100 | 100 | 100 | 100 | 100 | 100 | 100 | 100 | 100 |
| Weft 1 | 62 | 59 | 49 | 32 | 16 | 100 | 100 | 100 | 100 |
| Weft 2 | 38 | 41 | 51 | 68 | 84 | — | — | — | — |
| | La (mm) | | | | | | | | |
| Warp 1 | 1.63 | 1.63 | 1.63 | 1.63 | 1.63 | 1.63 | 1.63 | 1.63 | 1.31 |
| Weft 1 | 2.02 | 8.80 | 8.80 | 8.80 | 8.80 | 8.80 | 2.02 | 2.02 | 8.80 |
| Weft 2 | 1.63 | 1.63 | 1.63 | 1.63 | 1.63 | — | — | — | — |
| | Lb (mm) | | | | | | | | |
| Warp 1 | 4.25 | 4.25 | 4.25 | 4.25 | 4.25 | 4.25 | 4.25 | 4.25 | 4.12 |
| Weft 1 | 37.65 | 31.73 | 31.73 | 31.73 | 31.73 | 31.73 | 37.65 | 37.65 | 31.73 |
| Weft 2 | 4.25 | 4.25 | 4.25 | 4.25 | 4.25 | — | — | — | — |
| | Elongation rate (%) | | | | | | | | |
| Warp 1 | 1.61 | 1.61 | 1.61 | 1.61 | 1.61 | 1.61 | 1.61 | 1.61 | 2.15 |
| Weft 1 | 17.63 | 2.60 | 2.60 | 2.60 | 2.60 | 2.60 | 17.63 | 17.63 | 2.60 |
| Weft 2 | 1.61 | 1.61 | 1.61 | 1.61 | 1.61 | — | — | — | — |

| | Examples | | | | | Comparative Examples | | | |
|---|---|---|---|---|---|---|---|---|---|
| | 1 Derivative | 2 Plain | 3 Plain | 4 Plain | 5 Plain | 1 Plain | 2 Plain | 3 Twill | 4 Plain |
| | Fabric properties Weave structure Weave density (th/2.54 cm) | | | | | | | | |
| Warp | 45 | 43 | 44.2 | 44 | 44 | 42.3 | 45 | 43 | 43 |
| Weft | 39 | 41 | 39 | 38 | 38 | 45.4 | 39 | 40 | 49 |
| | Ratio of elastic moduluses (B/A) | | | | | | | | |
| Warp | 1.3 | 1.6 | 1.5 | 1.5 | 1.5 | 1.9 | 1.2 | 2.1 | 2.4 |
| Weft | 3.8 | 5.6 | 7.2 | 8.9 | 10.3 | 2.4 | 1.8 | 1.7 | 2.4 |
| | Elongation recovery rate (%) | | | | | | | | |
| Warp | 99.5 | 99.5 | 99.5 | 99.5 | 99.0 | 99.0 | 93.0 | 100 | 99.5 |
| Weft | 99.5 | 99.0 | 99.0 | 99.5 | 98.5 | 99.0 | 95.0 | 99.0 | 97.0 |

Note.
Total fineness is a total filament number.
La is elongation at fineness dtex × 0.1 cN, and Lb is elongation at fineness dtex × 0.4 cN.

Examples 2 to 5

Woven fabrics of Examples 2 to 5 are produced in the same manner of Example 1 except for changes of total fineness, filament number, ratio as described in Table 1. The results are shown in Table 1.

Comparative Example 1

A thermoplastic polyester elastomer, with "Hytrel (registered trademark)" 6347 manufactured by DU PONT-TORAY CO., LTD. having a melting point of 215° C. as a core component and "Hytrel (registered trademark)" 4056 having a melting point of 153° C. as a sheath component, was prepared, and after each pellet is dried, they are melted by different extruders, each of them is measured with a gear pump and allowed to flow into a composite pack, and supplied to an extruding machine, thereby obtaining a 400 dtex monofilament elastic yarn with a core to sheath weight proportion being 70:30. This elastic yarn was used as weft yarn. Also, five 167 dtex-72 filaments yarns (WFOL manufactured by Toray Industries, INC.), which was a bright cation 1H processed yarn, were doubled to make 835 dtex (total fineness)−480 filaments yarns, and yarns produced by twisting the above yarns with a warp twist coefficient 100S, as described in Example 1, were used as warp yarn. Weaving conditions such as warp tension were adjusted to produce a plain-weave fabric described in Table 1, and the obtained woven fabric was processed under the same conditions as the above-described Example. The warp density and weft density of the obtained woven fabric are as shown in Table 1.

Comparative Example 2

A thermoplastic polyester elastomer, with "Hytrel (registered trademark)" 6347 manufactured by DU PONT-TORAY CO., LTD. having a melting point of 215° C. as a core component and "Hytrel (registered trademark)" 4056 having a melting point of 153° C. as a sheath component, was prepared, and after each pellet is dried, they are melted by different extruders, each of them is measured with a gear pump and allowed to flow into a composite pack, and supplied to an extruding machine, thereby obtaining a 700 dtex monofilament elastic yarn with a core to sheath weight proportion being 70:30. This elastic yarn was used as weft yarn. Five 167 dtex-72 filaments yarns (WFOL manufactured by Toray Industries, INC.), which was a bright cation 1H processed yarn, were doubled to make 835 dtex (total fineness)–480 filaments yarns, and yarns produced by twisting the above yarns with a warp twist coefficient 100S, as described in Example 1, were used as warp yarn. Weaving conditions such as warp tension were adjusted to produce a plain-weave fabric described in Table 1, and the obtained woven fabric was processed under the same conditions as the above-described Example. The warp density and weft density of the obtained woven fabric are as shown in Table 1.

Comparative Example 3

A thermoplastic polyester elastomer, with "Hytrel (registered trademark)" 6347 manufactured by DU PONT-TORAY CO., LTD. having a melting point of 215° C. as a core component and "Hytrel (registered trademark)" 4056 having a melting point of 153° C. as a sheath component, was prepared, and after each pellet is dried, they are melted by different extruders, each of them is measured with a gear pump and allowed to flow into a composite pack, and supplied to an extruding machine, thereby obtaining a 700 dtex monofilament elastic yarn with a core to sheath weight proportion being 70:30. This elastic yarn was used as weft yarn. Five 167 dtex-72 filaments yarns (WFOL manufactured by Toray Industries, INC.), which was a bright cation 1H processed yarn, were doubled to make 835 dtex (total fineness)–480 filaments yarns, and yarns produced by twisting the above yarns with a warp twist coefficient 100S, as described in Example 1, were used as warp yarn. Weaving conditions such as warp tension were adjusted to produce a twill-weave fabric described in Table 1, and the obtained woven fabric was processed under the same conditions as the above-described Example. The warp density and weft density of the obtained woven fabric are as shown in Table 1. The obtained woven fabric was subjected to heat treatment in the same manner as Example 1 so that the warp weaving density is 43 yarns/2.54 cm and the weft weaving density is 40 yarns/2.54 cm.

Comparative Example 4

A thermoplastic polyester elastomer, with "Hytrel (registered trademark)" 6347 manufactured by DU PONT-TORAY CO., LTD. having a melting point of 215° C. as a core component and "Hytrel (registered trademark)" 4056 having a melting point of 153° C. as a sheath component, was prepared, and after each pellet is dried, they are melted by different extruders, each of them is measured with a gear pump and allowed to flow into a composite pack, and supplied to an extruding machine, thereby obtaining a 400 dtex monofilament elastic yarn with a core to sheath weight proportion being 70:30. This elastic yarn was used as weft yarn. Five, paralleled 167 dtex–48 filament yarns of cationic dyeable polyester yarn (LOCII manufactured by Toray Industries, Inc.) are interlaced to produce a total fineness 835 dtex–240 filament yarn, and then twisted to produce a yarn with a twist coefficient of 70S, and the obtained yarn is used as warp yarn. A plain-weave fabric with a weft density of 43 yarns/2.54 cm and a warp density of 49 yarns/2.54 cm was produced. The obtained woven fabric was subjected to the same heat treatment as Example 1.

Shoes were produced, where the woven fabrics obtained in Examples 1 to 5 and Comparative Examples 1 to 4 were used for the upper part of the shoes. Sensory evaluation of the obtained shoes, in which four runners wore the shoes and ran 1000 m, was conducted on fitting property, easiness to toe-off, and wear comfort.

The shoes produced with the woven fabrics of Examples 1 to 5 were excellent in elasticity in normal running in a straight line (a low load region). Also, these shoes were good in fitting property especially when runners run a curve (a high load region) as the fabric showed significantly increased elastic modulus, being less elastic, and leaving little gap between the foot and the shoe. The shoes produced with the woven fabric of Example 5 was high in fitting property especially in a high load region, when a runner run a curve, as the fabric was significantly increased in elastic modulus, making the shoes less deformable. On the other hand, the shoes produced with the woven fabric of Comparative Examples 1 to 4 caused feeling of loose fitting especially in a high load region, when a runner run a curve, as the fabric was elongated and deformed, creating a space between the foot and the shoe.

LIST OF REFERENCE SIGNS

1 stress-strain curve of a woven/knit fabric of the embodiment

1*a* stress-strain curve of an ordinary elastic woven fabric

A elastic modulus at elongation (P×0.8) (%)

B elastic modulus at elongation (P×1.2) (%)

P elongation (%)

The invention claimed is:

1. A woven or knit fabric, comprising two or more types of yarn different in elongation rate, wherein the two or more types of yarn different in elongation rate are separately arranged as independent threads in the same direction in at least one of warp and weft; and wherein a stress-strain curve obtained by applying load in a direction parallel to the direction of the arrangement of the threads has an inflection point; and includes a point satisfying an equation:

$$5.6 \leq B/A \leq 12$$

where, with a reference where the woven or knit fabric is subjected to load and has an elongation of P (%), A is an elastic modulus of the woven or knit fabric when the woven or knit fabric is subjected to load and has an elongation of (P×0.8) (%) and B is an elastic modulus of the woven or knit fabric when the woven/knit fabric is subjected to load and has an elongation of (P×1.2) (%).

2. The woven or knit fabric of claim 1, wherein elongation recovery rate of the woven or knit fabric after the load is released from the situation in which the woven or knit fabric is subjected to load and has an elongation of (P×1.2) (%) is not less than 90%.

3. The woven or knit fabric of claim 1, wherein a content of a yarn having the highest elongation rate among the two or more types of yarns differing in elongation rate in 100 mass % of the entire yarn is 10 to 90 mass %.

4. The woven or knit fabric of claim 1, wherein a yarn having the highest elongation rate among the two or more types of yarns different in elongation rate comprises fused yarn, in which yarns are fused each other.

5. The woven or knit fabric of claim 1, wherein a yarn having the highest elongation rate among the two or more types of yarns different in elongation rate is a monofilament.

6. The woven or knit fabric of claim 1, wherein a yarn having the lowest elongation rate among the two or more types of yarns different in elongation rate is a multifilament.

* * * * *